US005857567A

United States Patent [19]

Cheng

[11] Patent Number: 5,857,567

[45] Date of Patent: Jan. 12, 1999

[54] GOLF BAG HAVING A SUPPORT STAND

[76] Inventor: Du-Ping Cheng, No. 70, Su Chie Road, Wan Lee Township, Mau Li Hsien, Taiwan

[21] Appl. No.: 841,693

[22] Filed: Apr. 30, 1997

[51] Int. Cl.[6] ..... A63B 55/00; A63B 55/06

[52] U.S. Cl. ..... 206/315.7; 206/315.8; 248/96

[58] Field of Search ..... 206/315.3, 315.7, 206/315.8; 248/96

[56] References Cited

U.S. PATENT DOCUMENTS

| | | | |
|---|---|---|---|
| Re. 35,684 | 12/1997 | Maeng | 206/315.7 X |
| 4,834,235 | 5/1989 | Solheim et al. | 206/315.8 X |
| 5,042,654 | 8/1991 | Jones | 206/315.3 |
| 5,154,377 | 10/1992 | Suk | 206/315.7 X |
| 5,209,350 | 5/1993 | Maeng | 206/315.7 |
| 5,340,063 | 8/1994 | Hsieh | 206/315.7 X |
| 5,351,921 | 10/1994 | Chen | 206/315.7 X |
| 5,415,285 | 5/1995 | Reimers | 206/315.8 X |
| 5,464,180 | 11/1995 | Cheng | 206/315.7 X |
| 5,507,384 | 4/1996 | Maeng | 206/315.7 |
| 5,516,064 | 5/1996 | Hsieh | 248/96 |
| 5,607,128 | 3/1997 | Suk | 206/315.7 X |
| 5,662,296 | 9/1997 | Wu | 206/315.7 X |

FOREIGN PATENT DOCUMENTS

| | | | |
|---|---|---|---|
| 156107 | 7/1951 | Australia | 206/315.6 |

*Primary Examiner*—Sue A. Weaver
*Attorney, Agent, or Firm*—Browdy and Neimark

[57] ABSTRACT

A golf bag comprising a cover lid, a base bracket and a tubular body disposed therebetween is provided. The golf bag bas a tubular configuration and is provided with a supporting legs set such that the golf bag can stand firmly on the ground. The supporting legs set includes a pair of supporting legs, a spring member which is disposed between supporting legs and the driving plate. Characterized in that the cover lid and the base bracket are well supported by a supporting rod and the supporting legs set. The underside of the base bracket is provided with a planar portion, an inclined portion, a first slot and a second slot. The driving plate of the supporting legs set is pivotally attached to the first slot with its inner portion. The outer portion of the supporting legs set which is connected to the first spring member is received within the second slot. By this arrangement, the tubular body can be made from soft material since the cover lid is suitably supported by the supporting rod. The driving plate is also hidden under the inclined portion of the base bracket. In light of this, the golfer and boy will not stumble.

6 Claims, 4 Drawing Sheets

GOLF BAG HAVING A SUPPORT STAND

FIELD OF THE INVENTION

The present invention relates to a golf bag, more particularly, to a golf bag having reduced components and easily to assemble. On the other hand, the assembled golf bag has a smooth and planar outer surface without any protrusion thereof. Accordingly, the user will not be disturbed.

BACKGROUND OF THE INVENTION

In a conventional golf bag, it generally comprises a tubular body and an annular cover disposed at the top of the tubular body. A base bracket is disposed at the bottom of the tubular body. The outer periphery of the base bracket is pivotally mounted with a driving plate. A positioning stand is fixedly disposed at the side portion of the tubular body. A pair of supporting legs are disposed at the positioning stand. A V-shape spring is connected to the supporting at one end and the other end of the spring is connected to the driving plate. When the golf bag is pressed by the user as it has been disposed at the ground toward the direction of the driving plate such that it is tilted upward, with the inclined movement, the driving plate will move the V-shape spring upwardly such that the supporting legs are extended outward. By this arrangement, the golf bag can be readily supported by the supporting legs and the driving plate and stand inclinationally on the ground.

Even the conventional golf bag which can be readily stood inclinationally and vertically, can still be improved to have a better result.

1. In order to make the driving plate to have a better driving torque to drive the spring member, the driving plate is designed such that it has an extended length which may project over the outer periphery of the golf bag. On the other hand, the lower end of the V-shape spring member is also connected to the outer surface of the driving plate. Even this design may readily drive the extending spring member, however the extended driving plate can be an obstruction to the owner, if especially the golf bag is standing vertically.

2. Since the V-shape spring member exerts a stronger force to the supporting legs for extending outward, a reactive force will also exert on the outer wall of the tubular body. In order to overcome the reactive force applied from the spring member, the tubular body should be made from rigid or hard material. Undesirably, the overall weight of the tubular body is inevitable increased. This is really a burden to the golf boy.

SUMMARY OF THE INVENTION

It is the objective of this invention to provide an improved golf bag wherein the driving plate is adequately hidden under the base bracket.

It is still another object of this invention to provide an improved golf bag wherein the tubular body is made from soft and light material such that the overall weight is suitably reduced.

In order to achieve the objective set forth, the golf bag made according to the present invention generally comprises a tubular body, a cover lid disposed at the top of the tubular body and has an annular flange. A first positioning slot is disposed on a suitable position of the cover lid. A base bracket is disposed at the lower portion of the tubular body which has a second positioning slot corresponding to the first positioning slot. The underside of the base bracket is formed with a planar portion and an inclined portion. The planar portion is disposed under the second positioning slot. A pair of supporting legs are pivotally disposed on the cover lid. A first spring member having an upper split portion is provided. Each leg of the split portion is connected to one of the supporting legs respectively. The spring member has a curve lower portion and is connected to the base bracket. The driving plate is connected to the base bracket with its inner portion and is connected with the first spring member at its outer portion. By this arrangement, the driving plate will not be extended over the base bracket and the overall weight can be suitably reduced.

BRIEF DESCRIPTION OF THE DRAWINGS

In order that the present invention may more readily be understood the following description is given, merely by way of example with reference to the accompanying drawings, in which.

DETAILED DESCRIPTION OF THE INVENTION

Figure 1:
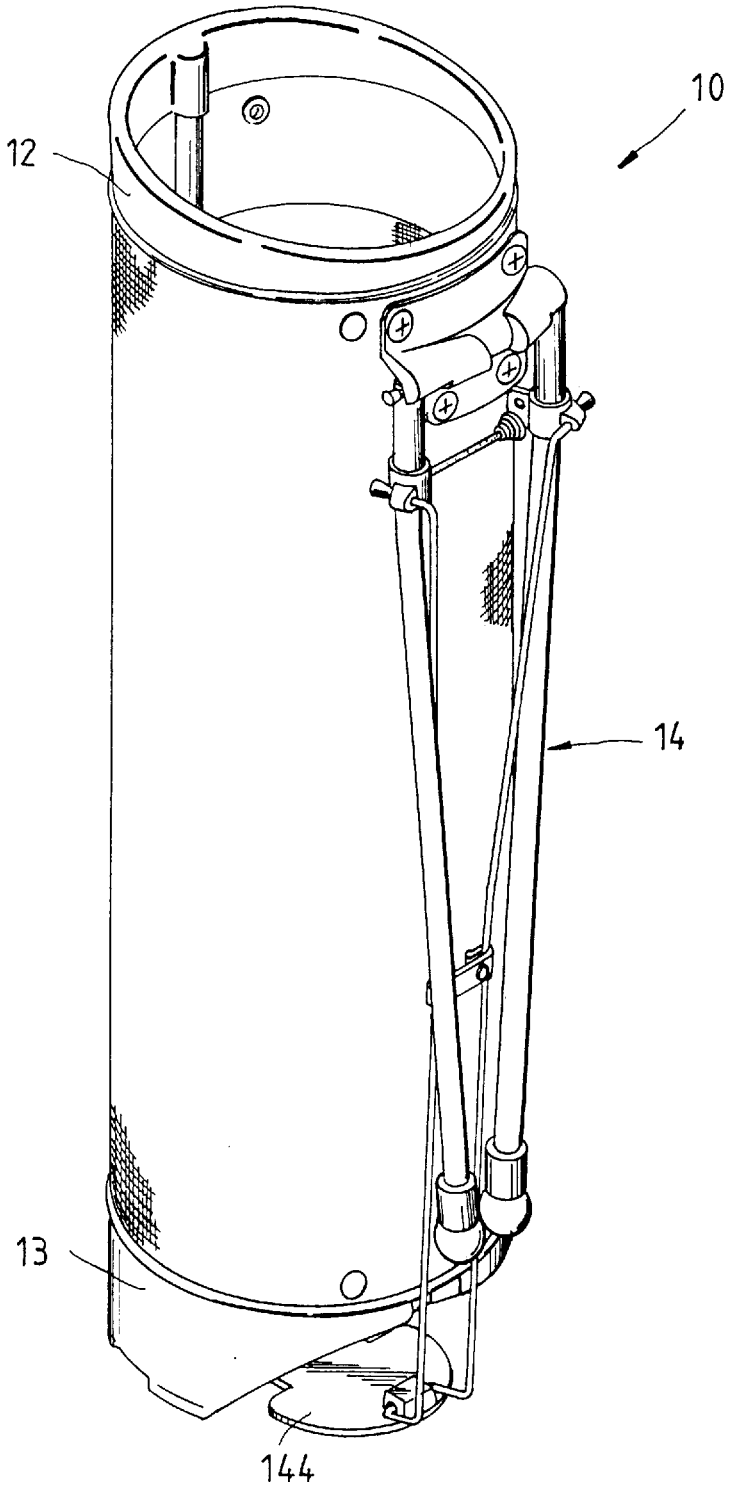
FIG. 1 is a perspective view of a preferred embodiment of the golf bag made according to the present invention wherein the golf bag is standing vertically.
Figure 2:
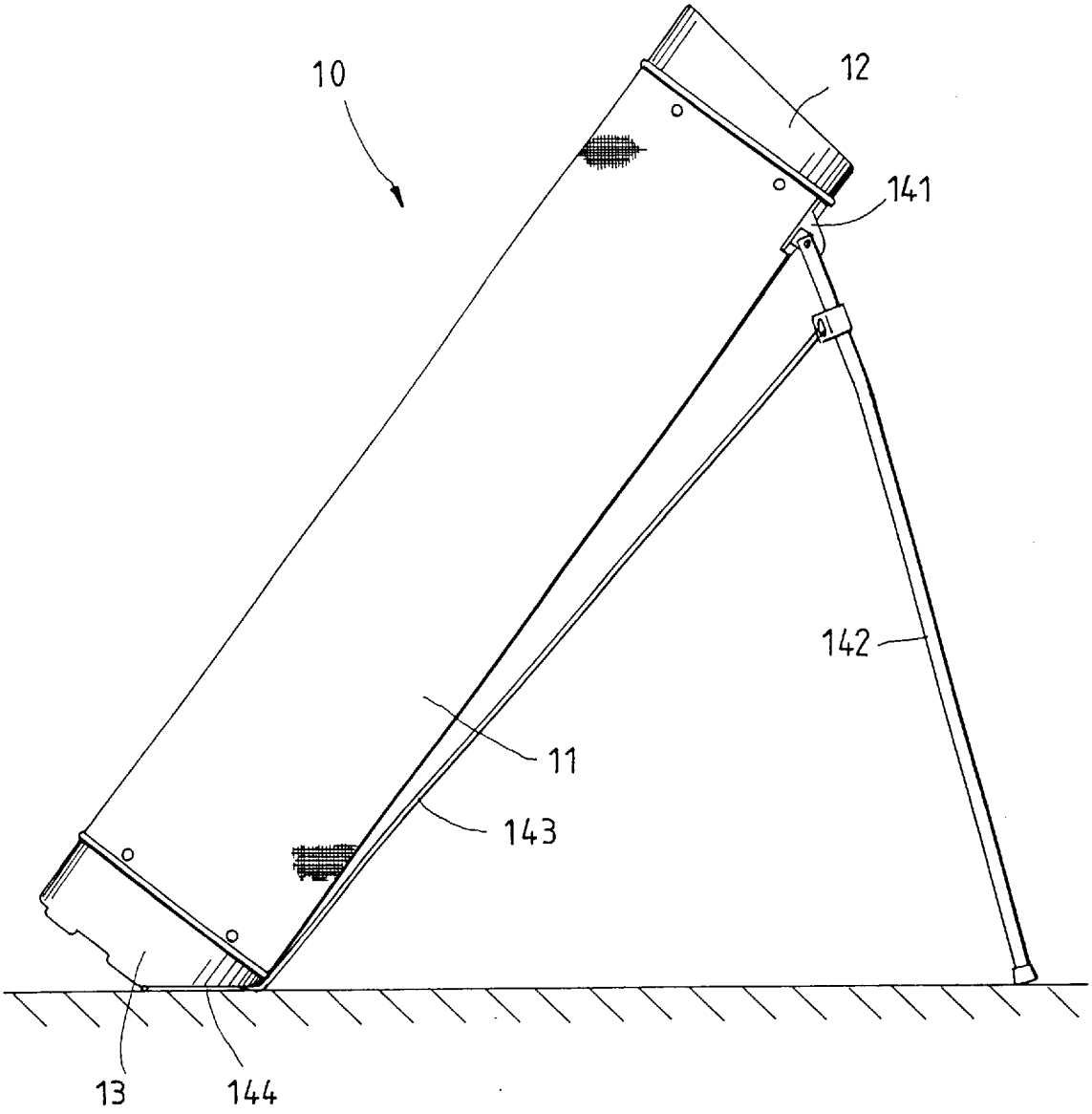
FIG. 2 is a side elevational view of the preferred embodiment of the golf bag made according to the present invention wherein the golf bag is inclined.
Figure 3:
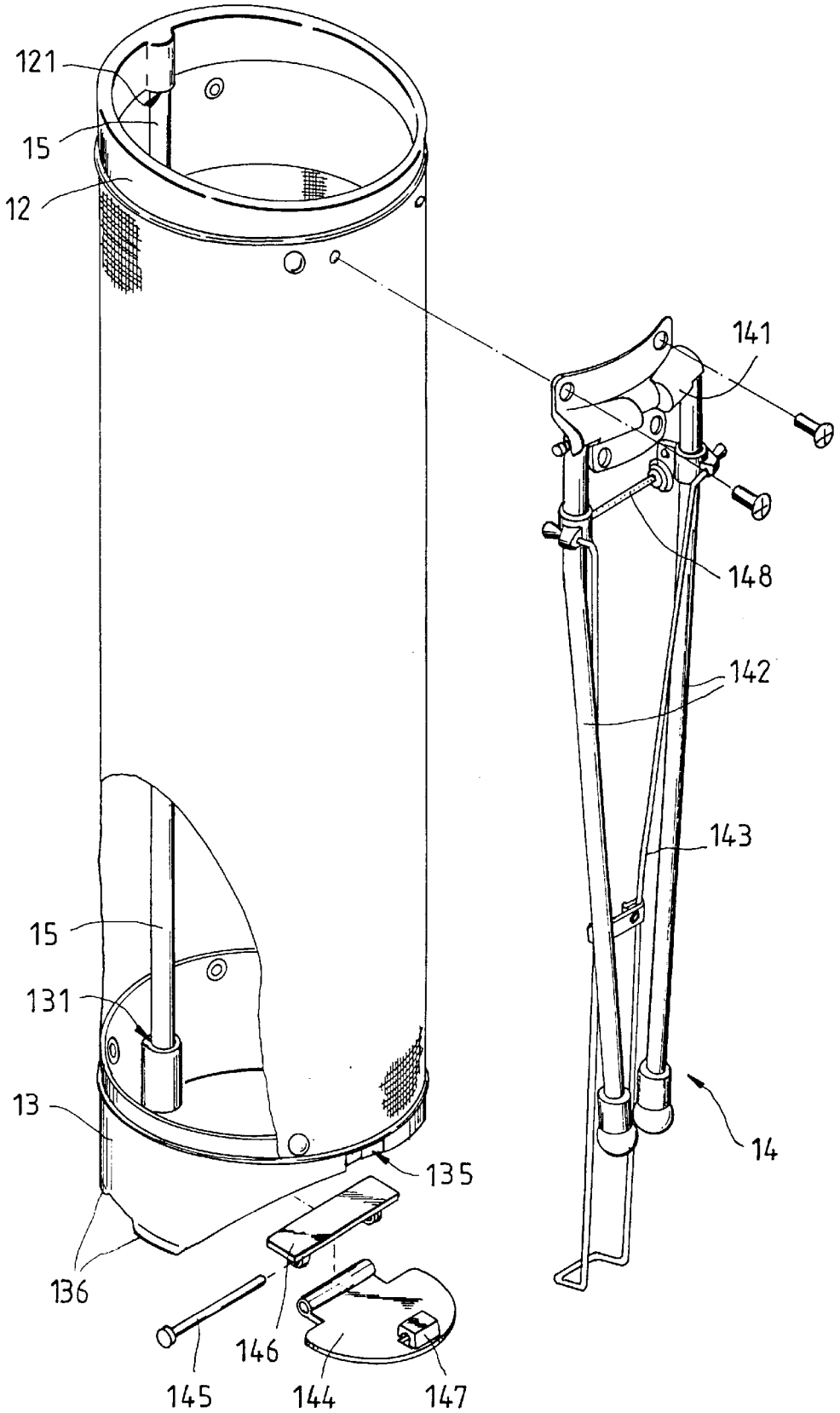
FIG. 3 is an exploded perspective view of the preferred embodiment of the golf bag.
Figure 4:
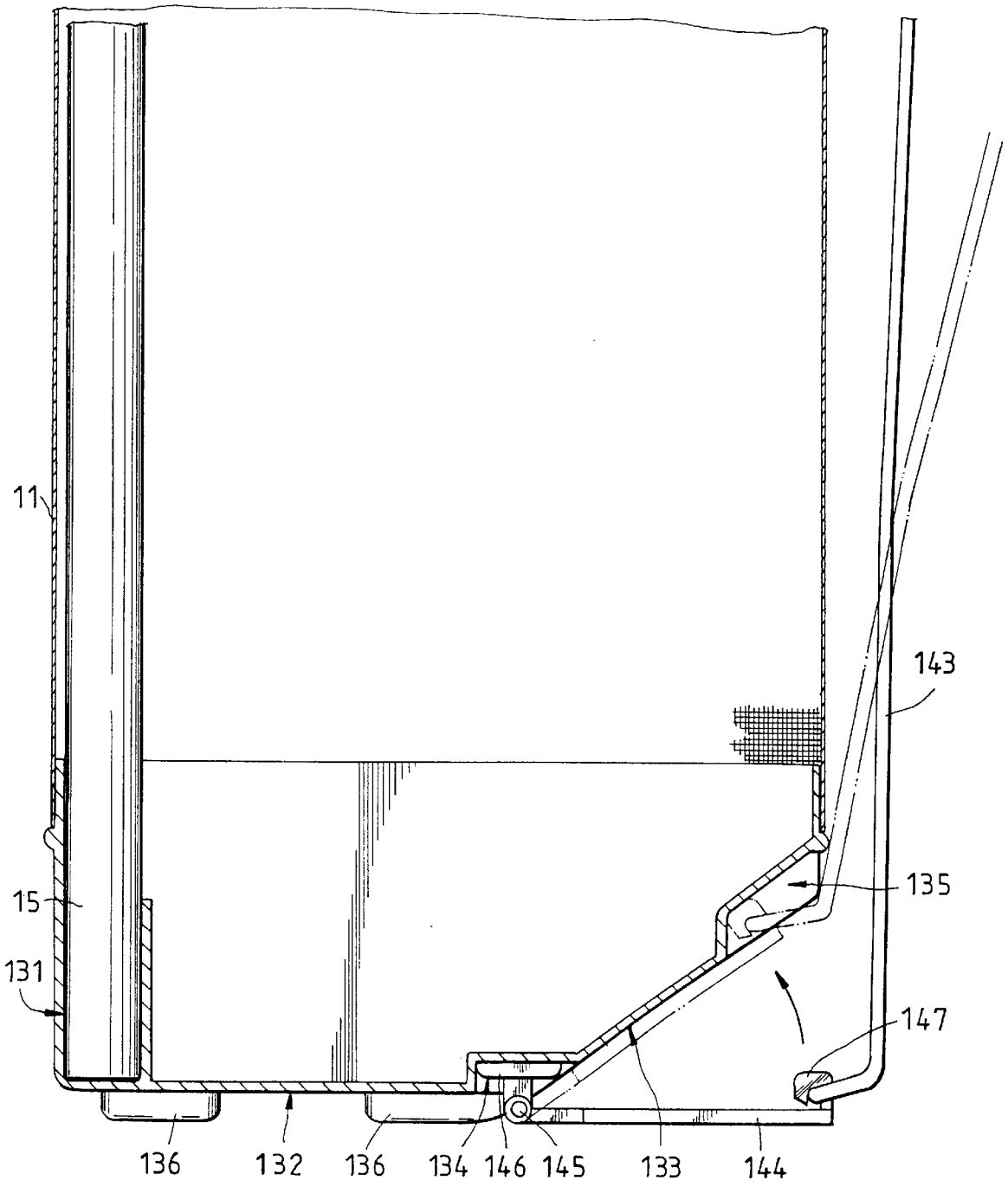
FIG. 4 is cross sectional view of the preferred embodiment of the golf bag.

The golf bag 10 made according to the present invention generally comprises a tubular body 11, a cover lid 12, a base bracket 13 and a pair of supporting legs 14.

The cover lid 12 has an annular configuration and is connected to the top of the tubular body 11 on its periphery. The inner portion of the cover lid 12 is provided with a first positioning slot 121 oriented downward.

The base bracket 13 has a disk configuration and is connected to the lower portion of the tubular body 11 on its periphery. The inner portion of the base bracket 13 is also provided with a second positioning slot 131 oriented upward. The first and second positioning slots 121 and 131 are aligned with each other and a supporting rod 15 can be received and retained within said first and second positioning slots 121, 131 at both ends. By this arrangement, the cover lid 12 and the base bracket 13 are connected and spaced from each other by the provision of the supporting rod 15. The ends of the supporting rod 15 can be also fastened to the cover lid 12 and the base bracket 13 by means of screws or equivalent if required. The underside of the base bracket 13 is defined with a planar portion 132 corresponding to the second positioning slot 131. An inclined portion 133 adjacent to the planar portion 132 is also provided.

The supporting legs set 14 includes a first positioning element 141 fixedly attached to the cover lid 12. A pair of supporting legs 142 are pivotally attached to both sides of the first positioning element 141. A first spring member 143 having a pair of legs at its top are connected respectively to a corresponding supporting leg 142. By this arrangement, the supporting legs 142 are continuously exerted with force such that the supporting legs 142 can be closed together. The lower portion of the spring 143 has a curve configuration and is extended to the underside of the base bracket 13. A driving plate 144 is pivotally attached to a second positioning element 146 by means of a pivotal shaft 145. The free end of the driving plate 144, which can be moved between a first and second positions, is provided with hooking means 147 for retaining the free end of the first spring member 143. Further, in order to enhance the retracting force which may move the supporting legs 142 close as to the outer surface of the tubular body 11 as possible, a second spring member 148 can be disposed between the supporting legs 142 and which is preferable made from an elastic strap.

When the golf bag 10 is standing vertically on the ground it can be pressed by the owner downward such that the golf bag 10 is tilted toward the supporting legs set 14, the depressed driving plate 144 will be pivoted upward around the pivotal shaft 145. Meanwhile, the first spring member 143 will be driven upward such that the supporting legs 142 are separated from each other by the first spring member 143. Finally, the golf bag 10 will stand inclinationally by the provision of the supporting legs 142 and the driving plate 144.

The golf bag 10 made according to the present invention can be configured with the following features.

1. The cover 12 is well supported by the combination of the supporting legs set 14 and the supporting rod 15 and is not supported by the tubular body 11.

2. The base bracket 13 is provided with a first positioning slot 134 which receiving the second positioning element 146 and which is also adjacent to the inclined portion 133. The inclined portion 133 is provided with a second slot 135 at the outer periphery of the base bracket 13.

3. The width of driving plate 144 is same to the width of the inclined portion 133, accordingly, the driving plate 144 can be completely retracted under the base bracket 13. Furthermore, the second positioning element 146 which is used for pivotally mounting the driving plate 144 is which disposed within the first slot 134 while the hooking means 147 is received in the second slot 135.

4. The lower curve portion of the first spring member 143 is firstly extended under the base bracket 13 and is then engaged with the hooking means 147.

5. The first positioning element 141 for pivotally mounting the supporting legs is fixedly disposed onto the cover lid 12 and is not fixed to the tubular body 11.

The golf bag 10 accordingly can achieve the following three features in use.

1. When the golf bag 10 is standing vertically, the driving plate 144 is in a first position (horizontal position) and is coplanar with the planar portion 132. In light of this, the golf bag 10 can stand vertically on the ground. As shown in the Figures, the planar portion 132 is further provided with a plurality of reinforced blocks 136. It is preferable that the reinforced blocks 136 and the driving plate 144 are coplanar so as to increase stability.

The driving plate 144 is disposed under the base bracket 13 and the first spring member 143 extends along the outer periphery of the tubular body 11. The curved end portion is also extended under the base bracket 13 to avoid obstructing the user.

2. When the golf bag 10 stands inclinationally on the ground, the driving plate 144 is moved to the second position and rested on the inclined portion 133. In this case, the hooking means 147 will be moved into the second slot 135 such that the inclined portion 133 and the driving plate 144 are jointly rested onto the ground. In light of this, the golf bag 10 stands firmly on the ground.

3. The upper portion of the supporting legs set 14 and the first positioning element 141 are fixedly attached to the cover lid 12. Accordingly, the cover lid 12 is firmly and jointly supported by the supporting legs set 14 and the supporting rod 15. On the other hand, the tubular body 11 can be made from soft and light material since the supporting legs set 14 do not need to be supported. For example, the tubular body 11 can be readily made from canvas or nylon. Accordingly, both the manufacturing cost as well as overall weight of the bag are reduced.

What is claimed is:

1. A golf bag, comprising a tubular body;

a cover lid being attached to a top of said tubular body, a first positioning slot being disposed on said cover lid;

a base bracket having a diameter substantially equal to the diameter of said tubular body being engaged to a bottom of said tubular body, said base bracket being provided with a second positioning slot aligned with said first positioning slot and an underside of said base bracket defining a planar portion which is disposed under said second positioning slot and an inclined portion, said base bracket further provided with a first slot and a second slot disposed on said inclined portion;

a supporting rod being engaged between said first and second positioning slots; and a pair of supporting legs being pivotally attached to said cover lid by a first positioning element, a U-shaped first spring member having a pair of spring legs connected respectively to said supporting legs, a lower portion of said first spring connecting said supporting legs having a curve configuration and being extended to an underside of said base bracket, a driving plate being pivotally attached to said base bracket by a second positioning element fixed in said first slot, a free end of said driving plate having hooking means for pivotally engaging said lower portion of said first spring, wherein when said pair supporting legs are pivoted toward the golf bag said driving plate moves into a same plane as said planar portion and does not extend past the diameter of said base bracket or tubular body, wherein when said pair of supporting legs are pivoted away from the golf bag said driving plate is pivoted against said inclined portion and the lower end of said first spring member is received and retained within said second slot.

2. A golf bag as recited in claim 1, wherein the first positioning element is engaged on a periphery of said cover lid, and an upper end of each of said supporting legs is attached to said first positioning element.

3. A golf bag as recited in claim 1, further comprising a second spring member which is used to pull said supporting legs together.

4. A golf bag as recited in claim 1, wherein said first slot is disposed at an intersection between said planar portion and said inclined portion, and an inner side of said driving plate being pivotally attached to said second positioning element in said first slot.

5. A golf bag as recited in claim 1, wherein an outer portion of said driving plate is provided with said hooking means engaged with the lower end of said first spring member, wherein when said outer portion of said driving plate is moved toward said inclined portion, said hooking means and the lower end of said first spring member are jointly disposed within said second slot.

6. A golf bag as recited in claim 1, wherein said tubular body is made from soft material.

* * * * *